US005904299A

United States Patent [19]

Hans et al.

[11] Patent Number: 5,904,299

[45] Date of Patent: May 18, 1999

[54] FUEL INJECTOR

[75] Inventors: Waldemar Hans, Bamberg; Thomas Betzel, Markgröningen; Peter Asslaender, Bamberg; Reinhold Brueckner, Litzendorf; Uwe Grytz, Bamberg; Christian Preussner, Markgröningen; Stefan Lauter, Lautertal; Rainer Bottler, Baunach; Robert Schmidt-Hebbel, Hirschaid, all of Germany

[73] Assignee: Robert Bosch GmbH, Stuttgart, Germany

[21] Appl. No.: 08/809,804

[22] PCT Filed: Jul. 24, 1996

[86] PCT No.: PCT/DE96/01358

§ 371 Date: Sep. 15, 1997

§ 102(e) Date: Sep. 15, 1997

[30] Foreign Application Priority Data

Aug. 10, 1995 [DE] Germany ..... 195 293 75

[51] Int. Cl.[6] ..... B05G 7/12

[52] U.S. Cl. ..... 239/408; 239/432; 239/433

[58] Field of Search ..... 239/398, 399, 239/403, 405, 406, 408–10, 432, 433, 533.12; 123/531, 532, 533, 534

[56] References Cited

U.S. PATENT DOCUMENTS

| | | | |
|---|---|---|---|
| 4,976,295 | 12/1990 | Clusserath | 141/39 |
| 4,982,716 | 1/1991 | Takeda et al. | 123/531 |
| 5,035,358 | 7/1991 | Katsuno et al. . | |
| 5,218,943 | 6/1993 | Takeda et al. | 123/531 |
| 5,224,458 | 7/1993 | Okada et al. | 123/531 |
| 5,232,163 | 8/1993 | Grytz | 239/405 |
| 5,301,879 | 4/1994 | Taked et al. | 239/408 |
| 5,772,122 | 6/1998 | Sugiura et al. | 239/408 |

FOREIGN PATENT DOCUMENTS 41 03 918 8/1991 Germany .

*Primary Examiner*—Andres Kashnikow
*Assistant Examiner*—Lisa Douglas
*Attorney, Agent, or Firm*—Kenyon & Kenyon

[57] ABSTRACT

A housing body of a fuel injector has a multi-part design; it includes a base member and at least one calibrating sleeve. Air is supplied and metered in through the calibrating sleeve, while the base member is used for sealing and attachment purposes. A dimensionally accurate machining of calibrating sleeves can be carried out simply and cost-effectively. The structural design easily yields many different variants. The fuel injector is especially suited for fuel-injection systems of mixture-compressing internal combustion engines having externally supplied ignition.

11 Claims, 4 Drawing Sheets

FUEL INJECTOR

BACKGROUND INFORMATION

U.S. Pat. No. 4,982,716 describes a fuel injector for injecting an air-fuel mixture which, at the downstream end of a nozzle body, has an adapter into which air can be introduced. The air is supplied via two supply ducts or supply orifices, which run obliquely to the longitudinal valve axis and open through into an inner spray-discharge region of the adapter to allow the air to collide with the fuel either upstream or downstream from a centrally arranged collision surface. The collision surface partitions the fuel into two spray-discharge orifices. Over their length, the air-supply ducts have a constant diameter and a circular cross-section. To assure a precise metering-in of the air, the metering cross-section must be fabricated to very exact dimensions. Since the entire adapter has to be manipulated when the supply ducts are inserted, this machining step is relatively costly. Moreover, once the supply ducts have been inserted, one can no longer vary their size.

The above applies to fuel injectors as well, as disclosed, for example, in German Patent No. 41 03 918 and U.S. Pat. No. 5,035,358. Here, as well, air supply ducts, which always exhibit a constant diameter and circular cross-section, are provided in an adapter housing body on the valve. The supply ducts are, again, inserted directly in the housing body, so that the entire housing body has to be handled in order to machine them.

Therefore, in known injectors where air is supplied in an ancillary housing body, the two functions of supplying or metering air and of mounting on the injector must be jointly approached, so that it is hardly possible to optimally realize both functions because of the integration.

Therefore, in known fuel injectors, air is supplied in a housing body through air-supply ducts which are directed toward the fuel in a central orifice. These housing bodies are formed in one piece, making it impossible to variably meter in air and aggravating the insertion of the air-supply ducts.

SUMMARY OF THE INVENTION

An advantage of the fuel injector according to the present invention is that it offers a greater design freedom and is able to be produced less expensively because it provides for a separation of the functions in the housing body of the fuel injector, which preprocesses the fuel using its available and metered-in air. Moreover, the function of supplying and metering air with respect to sealing off the fuel injector from an intake line is advantageously separated from the function of attaching the housing body to the fuel injector, so that each function, by itself, is better assured.

It is especially advantageous to design the housing body as a multi-part housing to facilitate installation of at least one calibrating sleeve for dosing air in a base member. While the base member is actually used to seal off the fuel injector from an intake line and to attach the housing body, the calibrating sleeves are chiefly responsible for supplying and metering air.

It can be beneficial to provide a spray divider in the base member to sustain or enhance the fuel injector's dual-jet characteristic.

It is quite possible to have many variants, because different calibrating sleeves can be installed in base members of the same design for various, specific applications. This is achieved in the sense of a unit construction system.

The materials of the base member and of the calibrating sleeves can differ from one another advantageously. In selecting the material for the base member, single criteria, such as temperature sensitivity, have only a very subordinate role.

DETAILED DESCRIPTION

Figure 1:
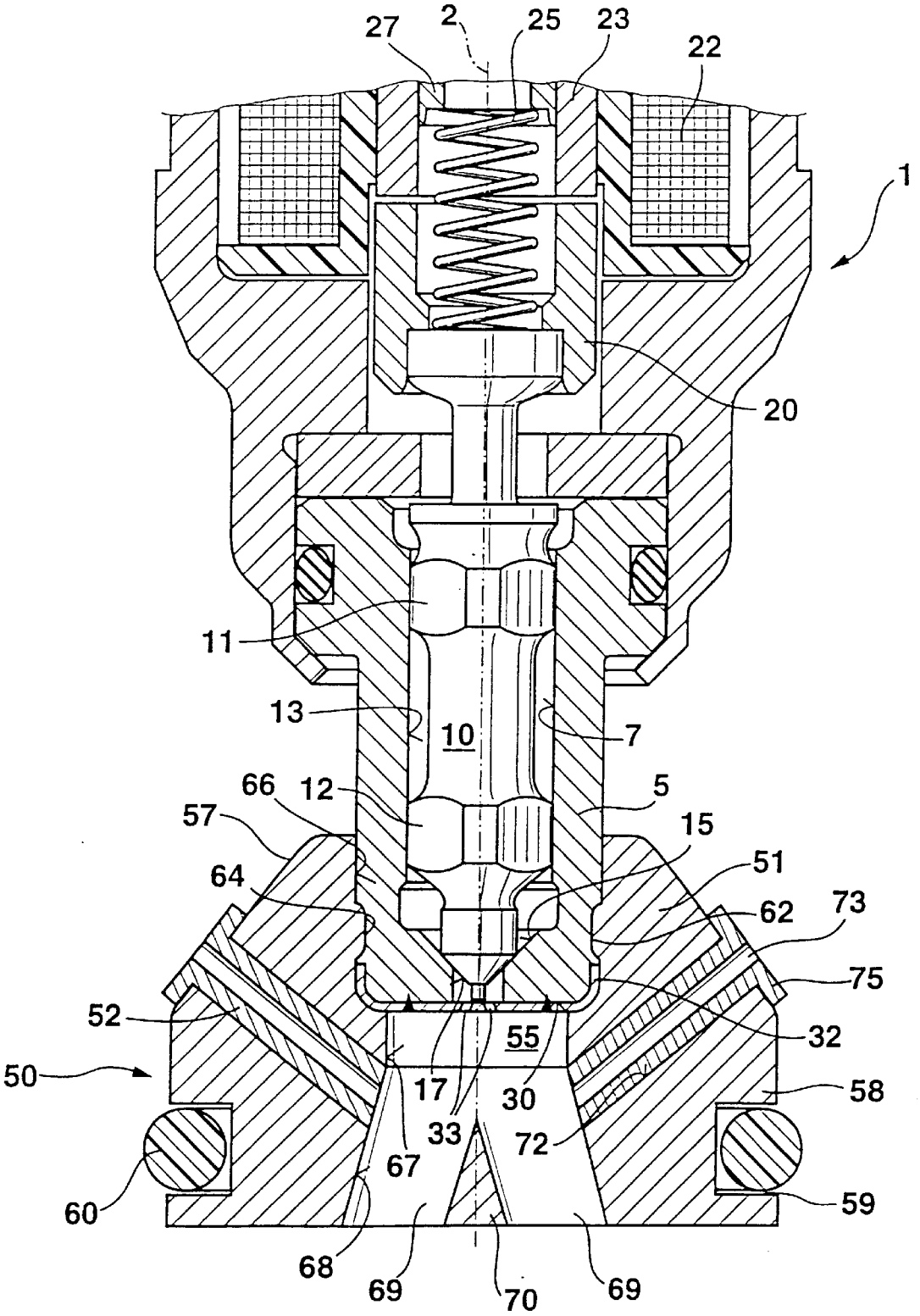
FIG. 1 shows a partial view of the fuel injector with a housing body of the present invention.

As a first exemplary embodiment of the present invention, FIG. 1 shows a partial view of a valve in the form of a fuel injector for fuel-injection systems of mixture-compressing internal combustion engines having externally supplied ignition. Together with a housing body according to the present invention, the fuel injector is used to inject an air-fuel mixture into an intake manifold or directly into a combustion chamber of the internal combustion engine.

The, for example, electromagnetically actuated fuel injector 1 extends concentrically along a longitudinal valve axis 2. As part of a valve housing, fuel injector 1 has a nozzle body 5 extending at the downstream end. Formed in nozzle body 5 is a stepped longitudinal bore 7, which runs concentrically to longitudinal valve axis 2 and has, for example, a needle-shaped valve-closure part 10 mounted therein. Valve-closure part 10 has, for example, two guide sections 11, 12, which, together with a guide region 13 of the inner wall of longitudinal bore 7 of nozzle body 5, are used to guide valve-closure part 10. At its downstream end, longitudinal bore 7 of nozzle body 5 has a fixed valve seat 15, which is tapered frustoconically in the direction of fuel flow and which, together with a sealing section 17 of valve-closure part 10 that is tapered frustoconically in the direction of fuel flow, forms a seat valve.

At its end facing away from sealing section 17, valve-closure part 10 is joined to a tubular armature 20, which cooperates with a solenoid coil 22, partially surrounding armature 20 in the axial direction, and with an opposing tubular core 23 of fuel injector 1 facing away from armature 20 in the fixed valve seat 15. Engaging with its one end on the end of valve-closure part 10 joined to armature 20 is a restoring spring 25, which is spring-loaded to move valve-closure part 10 in the direction of fixed valve seat 15. With its other end, restoring spring 25 braces against, e.g., a non-magnetic adjusting sleeve 27.

Fitting on one front end 30 of nozzle body 5 of fuel injector 1 facing away from core 23 is a spray-orifice plate 32, which is permanently joined to nozzle body 5, e.g., by means of a laser-produced welded seam. Spray-orifice plate 32 has, e.g., four spray orifices 33, through which fuel flowing past valve seat 15 is spray-discharged when valve-closure part 10 is lifted.

To supply and meter in air used to improve fuel preprocessing and atomization, a housing body 50 made, for example, of plastic is provided at the downstream end of fuel injector 1. The air can be, e.g., the air branched off through a by-pass upstream from a throttle valve in an induction pipe of the internal combustion engine, air delivered through an additional fan, but also the recycled exhaust gas of the internal combustion engine, or a mixture of air and exhaust gas. The use of recycled exhaust gas makes it possible to reduce the emission of pollutants from the internal combustion engine. FIG. 1 does not show in greater detail air being supplied up to housing body 50.

Housing body 50 is comprised of at least one base member 51 and of at least one calibrating sleeve 52 according to the present invention which is insertable into base member 51. Base member 51 is, for example, an injection-molded part of plastic and has a complete axial passage 55 for a fluid, whose structural design can vary to conform to the valve construction. The downstream end of nozzle body 5 projects into the upstream part of, e.g., passage 55 provided centrally around longitudinal valve axis 2, so that base member 51 partially radially surrounds nozzle body 5. Base member 51 also extends axially downstream from the downstream end of nozzle body 5 having spray-discharge orifices 33.

Base member 51 has, e.g., an outer contour, which does not extend with a constant diameter over its axial extent. Rather, at the level of the downstream end of nozzle body 5, base member 51 has, e.g., an upper section 57, whose outer contour runs obliquely with respect to longitudinal valve axis 2, the diameter of base member 51 widening in the downstream direction. Contiguous to upper section 57 is a bottom, downstream section 58 of base member 51, on whose periphery is provided, for example, a circumferential, annular groove 59. Insertable into annular groove 59 is a sealing ring 60 for providing sealing action between the periphery of the injector or of housing body 50 and a valve mount (not shown), e.g. the intake line of the internal combustion engine.

The entire housing body 50 is secured to the injector, in particular to nozzle body 5, e.g., by snapping into place a bulb-type enlargement 62, which is formed circumferentially in upper section 57 at inner passage 55, extends from the inner wall radially toward longitudinal valve axis 2, and is low in height, to ensure that the connection will not loosen because of vibrations or the effects of temperature. A complete locking against rotation can be assured by suitably selecting bulb-type enlargement 62 and groove 64. The locking against rotation is achieved by means, e.g., of mating and cooperating depressions or elevations on bulb-type enlargement 62 and in groove 64. Other methods for joining housing body 50 to nozzle body 5, besides lock-in or snap-in type engagements, are conceivable, such as bonding or shrink-fitting, which, however, also yield permanent connections. It is also possible to lock housing body 50 against rotation using a knurled formation or surfaces in the bottom of groove 64 on nozzle body 5.

In the first exemplary embodiment shown in FIG. 1, passage 55 is divided into three axially successive sections. A first upstream passage section 66 is diametrically sized to accommodate the downstream end of nozzle body 5. The opening width of passage section 66 is somewhat smaller in the area of bulb-type enlargement 62 than over its remaining length. Contiguous to and smaller in diameter than passage section 66 is a second, middle, cylindrical passage section 67, so that a step is formed in housing body 50, on which nozzle body 5 fits, e.g., with its spray-orifice plate 32, and can no longer extend into passage section 67. Directly following the middle passage section 67 in the downstream direction is a third, bottom passage section 68, which is distinguished, e.g., by two openings 69. If the intention is, namely, to achieve or maintain a dual-jet characteristic of fuel injector 1, for example, to inject fuel in the direction of two injectors, it is expedient to provide a spray divider 70 that extends between the two openings 69 in the bottom passage section 68 of base member 51.

Depending on the desired spray angle and configuration, widely varying designs of spray divider 70 are possible. In FIG. 1, the web-type spray divider 70 is shown exemplary with an acute edge directed toward spray-orifice plate 32, while its cross-section broadens from the edge in the downstream direction and is, thus, triangular. The dual-jet characteristic already produced, e.g., by spray-discharge orifices 33 of spray-orifice plate 32, but which can be adversely affected by intermediately supplied air, is, therefore, maintained or is enhanced by spray divider 70. Of course, one can also do without a spray divider 70 in base member 51 when there is no need for a multi-jet fuel characteristic.

Air is supplied to the fuel passing through passage 55 via one or more calibrating sleeves 52. Calibrating sleeves 52 are inserted in passage openings 72 of base member 51, which run, for example, obliquely to longitudinal valve axis 2, starting from the inclined top section 57 of the outer contour, through base member 51 up to the inner walls of openings 69 of the bottom passage section 68. The outer diameter of calibrating sleeves 52, as well as the diameter of passage openings 72 are selected to enable an interference fit and, thus, to rule out any slipping of calibrating sleeves 52. The hollow cylindrical calibrating sleeves 52 have a traversing inner longitudinal orifice 73, through which the air is supplied. The inner longitudinal orifices 73 are fabricated or calibrated very precisely in their cross-section and define or dose the air volume flowing into passage 55. At its upper end, calibrating sleeve 52 has, e.g., a flat collar 75, which is larger in diameter than passage opening 72 and which abuts on upper section 57 of the outer contour of base member 51. In this exemplary embodiment, longitudinal orifices 73 of calibrating sleeves 52 have a constant diameter over their entire length.

Thus, the air-dosing function is assigned to a separate component, namely to longitudinal orifice 73 of calibrating sleeve 52, which can be fabricated with precisional accuracy separately from base member 51. Known injectors having air-containing functions are provided with single-part housing bodies having air-supply ducts, which are very expensive to manufacture because of the required high dimensional accuracy of the metering cross-section. In the case of housing body 50 of the present invention, a functional separation is achieved by the multi-part feature (base member 51/calibrating sleeves 52). Calibrating sleeves 52 are able to be manufactured as small parts in large quantities much less expensively, using simple machining processes. As a result, the materials of base member 51 are able to be advantageously distinguished from those of calibrating sleeves 52. As already mentioned, base member 51 can be an injection-molded part of plastic, for example; however, other materials are equally conceivable. In selecting the material for base member 51, individual criteria, such as temperature sensitivity, still have just a very subordinate role. As a result, greater design freedom is attained for housing body 50. Moreover, it is thus easily possible to equip existing base members 51 with different calibrating sleeves 52, so that a wide range of variants is attainable without necessitating substantial modifications on housing body 50.

Figure 2:
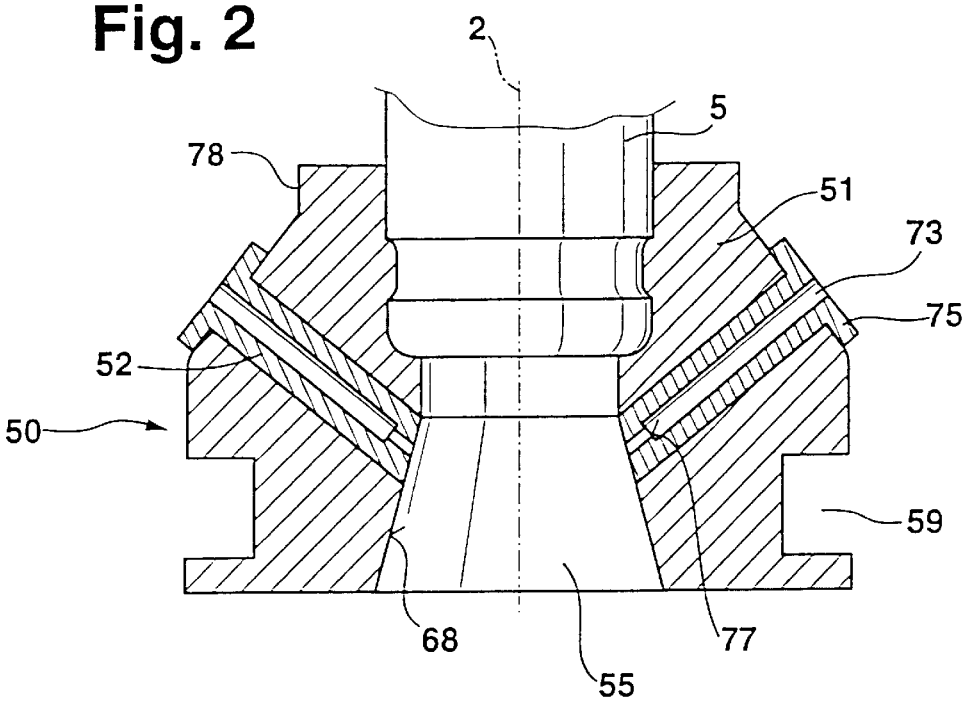
FIG. 2 shows a second example of a housing body.

All other Figures focus on the refinement of housing body 50 or of calibrating sleeves 52 and show fuel injector 1 in a simplified and schematic view with the downstream end of nozzle body 5. Calibrating sleeves 52 of the exemplary embodiment in FIG. 2 differ from those of FIG. 1 in that their inner longitudinal orifices 73 vary in opening width along the direction of flow. As shown, this can be achieved, e.g., by means of a step 77 or also in a stepless, continuous manner in the form of conical orifices. The bottom passage section 68 is designed, e.g., as a completely conical orifice section that widens in the direction of flow; in other words, it does not have any spray divider. Moreover, the outer contour of base member 51 has a somewhat modified shape, in that, in its upper section 57, base member 51 is, for example, not completely chamfered, but has an upper cylindrical end section 78.

Figure 3:
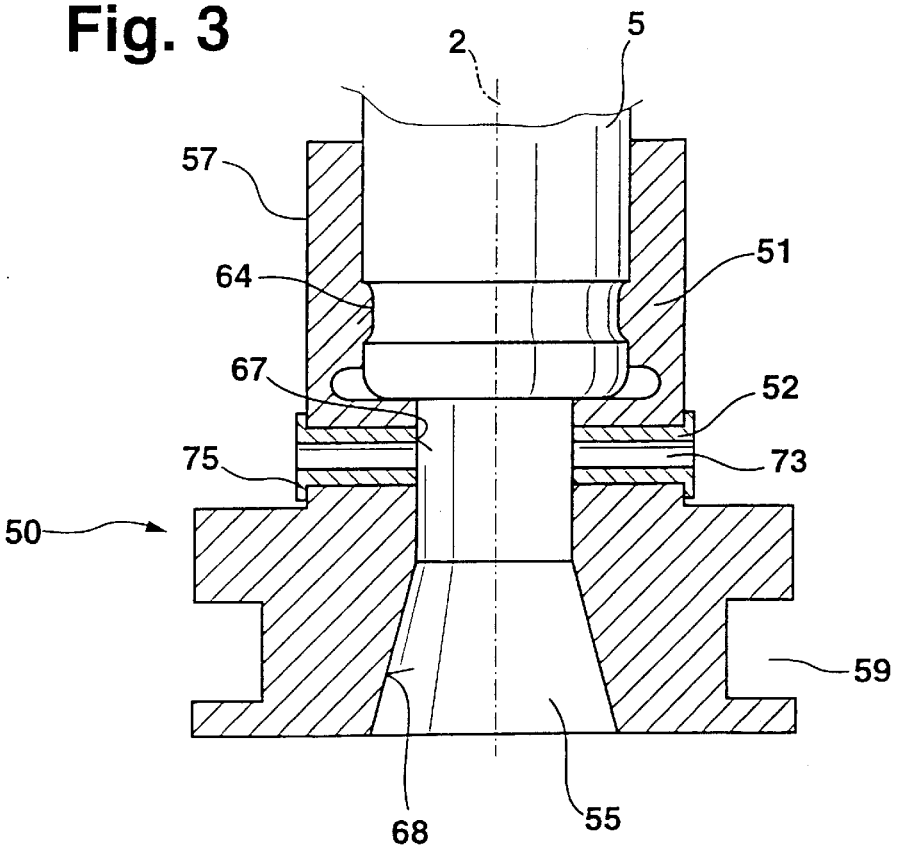
FIG. 3 shows a third example of a housing body.

FIG. 3 shows a housing body 50 with a base member 51 that has a vertical outer contour and thus runs parallel to longitudinal valve axis 2 in the area of upper section 57. Thus, upper section 57 has a cylindrical form and surrounds the downstream end of nozzle body 5, depicted only schematically, in the same way as in the exemplary embodiments already described. Based on the vertical outer contour of section 57, calibrating sleeves 52 run, for example, horizontally, at right angles to longitudinal valve axis 2 up to inner passage 55. They fit, in turn, with their collar 75 on the outer wall of upper section 57. The metering, inner longitudinal orifices 73 of calibrating sleeves 52 open through, e.g., into the middle, cylindrical passage section 67 of section 55, since section 57 extends axially in the downstream direction as far as the middle passage section 67. Thus, air is supplied to the fuel downstream from nozzle body 5, near spray-discharge orifices 33.

Figure 4:
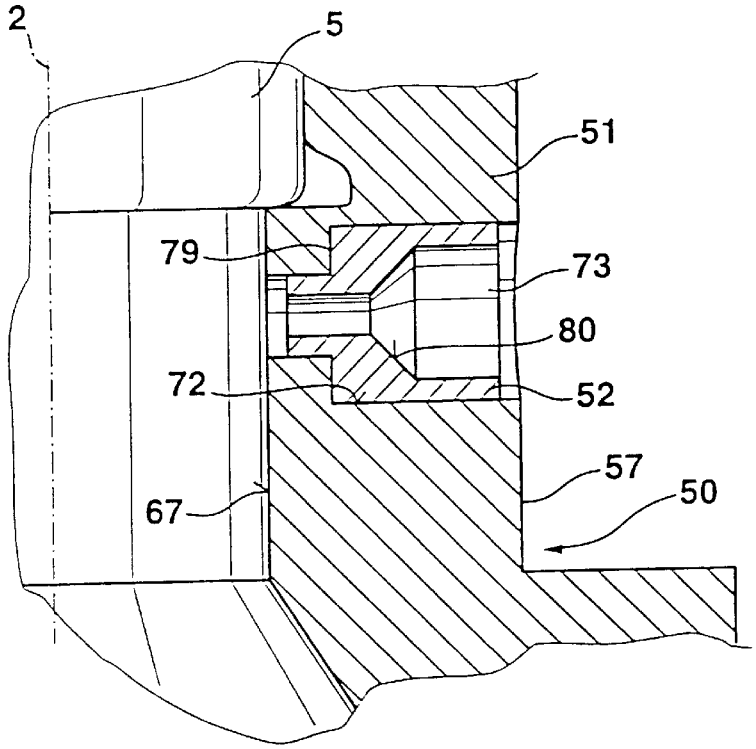
FIG. 4 shows the detail of a housing body with a stepped calibrating sleeve.

FIGS. 4 through 7 illustrate other exemplary embodiments of calibrating sleeves 52, whose configuration corresponds to the exemplary embodiment shown in FIG. 3, i.e., they extend horizontally from outer section 57 up to middle passage section 67. FIG. 4 reveals an example of a calibrating sleeve 52, which extends neither up to the outer wall of section 57 nor to the wall of passage section 67, but rather ends just before them on both sides. Passage opening 72 provided in base member 51 for fitting in calibrating sleeve 52 has, e.g., a stepped design, since a recess 79 is provided in base member 51 to reduce the diameter of passage opening 72 toward longitudinal valve axis 2. Given a suitably designed calibrating sleeve 52 with a step on its outer periphery, calibrating sleeve 52 fits with dimensional accuracy on recess 79. In place of a step 77 for changing the opening width of inner longitudinal orifice 73, longitudinal orifice 73 can also have a conical tapering 80 to allow the air flow rate to be brought to a desired value.

Figure 5:
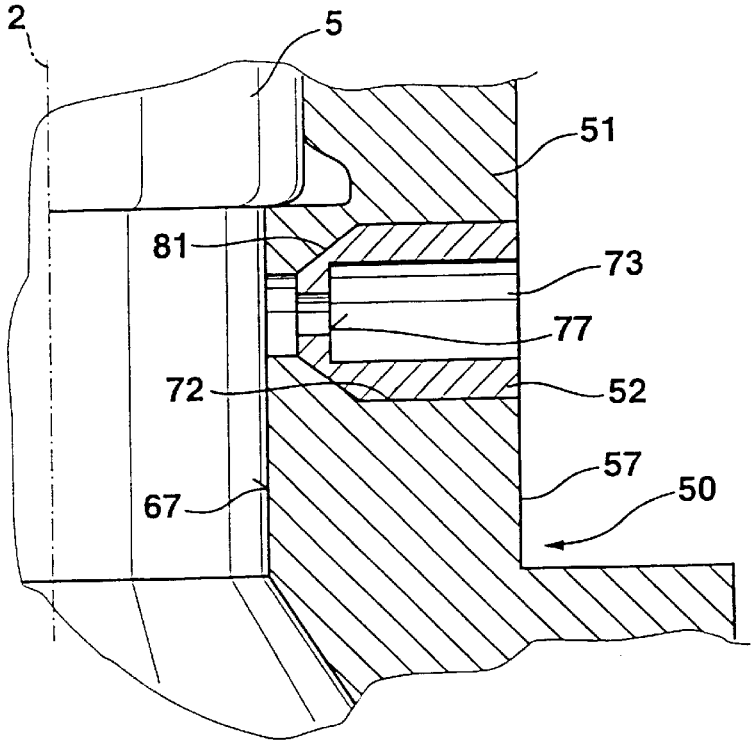
FIG. 5 shows the detail of a housing body with a partially conical calibrating sleeve.

Calibrating sleeve 52 shown in FIG. 5 has an inner longitudinal orifice 73 with a step 77 that reduces the orifice width. In contrast, the passage opening 72 has a conical tapering 81, which, in turn, also predefines the outer contour of calibrating sleeve 52. Thus, calibrating sleeve 52 likewise has a conical outer region, which is designed to conform to the conicity of passage opening 72. Toward middle passage section 67, the diameter of passage opening 72 corresponds to the diameter of calibrating sleeve 52 at the end of the conical tapering.

Figure 6:
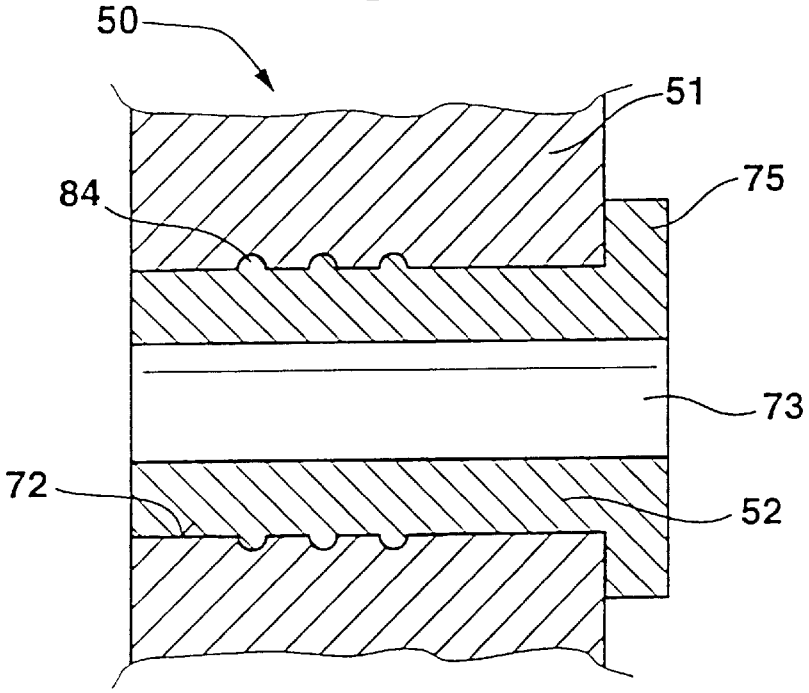
FIG. 6 shows a calibrating sleeve with bulb-type enlargements on its periphery.
Figure 7:
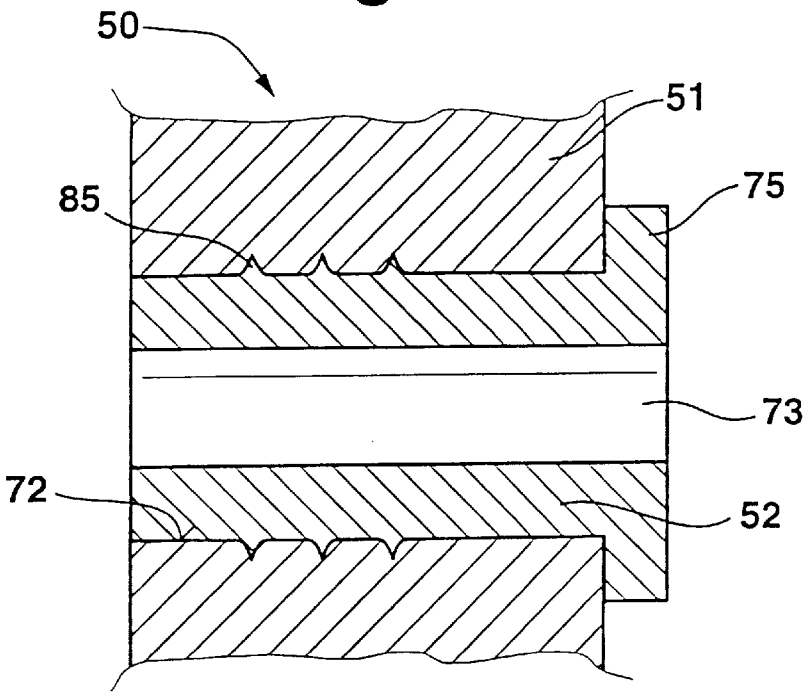
FIG. 7 shows a calibrating sleeve with pointed notches on its periphery.

FIGS. 6 and 7 show two calibrating sleeves 52, which are distinguished by additional safeguards. Calibrating sleeves 52 press-fit into passage openings 72 can have, e.g. on their is outer periphery, anti-slip means, such as rounded bulb-type enlargements 84 or pointed notches 85, which dig into the material of base member 51 and, thus, represent an anti-slip safeguard for calibrating sleeves 52.

Besides the illustrated exemplary embodiments, there are other conceivable variants which will be briefly mentioned in the following. Thus, for example, the number of calibrating sleeves 52 per housing body 50 is variable. In the usual case, one to six calibrating sleeves 52 would be inserted. Calibrating sleeves 52 can be either directly aligned to spray-discharge orifices 33 of spray-orifice plate 32 of fuel injector 1, or also not directly aligned. Besides the depicted circular cross-section of longitudinal orifices 73, square, rectangular (slot-shaped), oval and other cross-sectional shapes are conceivable. To safeguard against a slipping of calibrating sleeves 52 into passage openings 72, calibrating sleeve 52 can have, e.g., a collar 75 (FIGS. 1, 2, 3, 6, 7), a recess 79 (FIG. 4) or a cone (FIG. 5). Given ample squeezing action, a variant without safeguards is also conceivable.

What is claimed is:

1. A fuel injector for a fuel-injection system for injecting an air-fuel mixture into an internal combustion engine, the injector having a longitudinal valve axis, comprising:

a movable valve-closure part;

a nozzle body having a valve seat cooperating with the valve-closure part, at least one spray-discharge orifice being disposed downstream from the valve seat; and a housing body arranged at a downstream end of the injector, the housing body including a base member having an inner axial passage and including at least one calibrating sleeve arranged in the base member, the calibrating sleeve having a traversing longitudinal orifice in fluid communication with the inner axial passage such that air supplied in the traversing longitudinal orifice mixes with fuel injected into the inner axial passage.

2. The fuel injector according to claim 1, wherein the base member and the calibrating sleeve are composed of plastic.

3. The fuel injector according to claim 1, wherein the calibrating sleeve runs obliquely to the longitudinal valve axis.

4. The fuel injector according to claim 1, wherein the calibrating sleeve runs perpendicular to the longitudinal valve axis.

5. The fuel injector according to claim 1, wherein the calibrating sleeve is arranged in a passage opening of the base member extending from an outer contour of the base member to the inner axial passage.

6. The fuel injector according to claim 5, wherein the calibrating sleeve extends over a full length of the passage opening.

7. The fuel injector according to claim 1, wherein the traversing longitudinal orifice has an abruptly reducing cross-section in a direction of air flow.

8. The fuel injector according to claim 1, wherein the traversing longitudinal orifice has a continuously reducing cross-section in a direction of air flow.

9. The fuel injector according to claim 1, further comprising an anti-slip safeguard arranged on an outer periphery of the calibrating sleeve.

10. The fuel injector according to claim 1, further comprising a spray divider arranged in the inner axial passage.

11. A fuel injector for a fuel-injection system for injecting an air-fuel mixture into an internal combustion engine, the injector having a longitudinal valve axis, comprising:

a movable valve-closure part;

a nozzle body having a valve seat cooperating with the valve-closure part, at least one spray-discharge orifice being disposed downstream from the valve seat; and a housing body arranged at a downstream end of the injector, the housing body including a base member having an inner axial passage and including at least one calibrating sleeve arranged in the base member, the calibrating sleeve having a traversing longitudinal orifice in fluid communication with the inner axial passage such that air supplied in the traversing longitudinal orifice mixes with fuel injected into the inner axial passage, the calibrating sleeve being arranged in a passage opening of the base member extending from an outer contour of the base member to the inner axial passage and having a flat collar at one end of the calibrating sleeve, the flat collar fitting on the outer contour of the base member.

* * * * *